US005550555A

United States Patent [19]

Cottrell

[11] Patent Number: 5,550,555

[45] Date of Patent: Aug. 27, 1996

[54] STRUCTURES SUBJECT TO LOADING

[75] Inventor: Peter R. Cottrell, Cumbria, United Kingdom

[73] Assignee: Vickers Shipbuilding & Engineering Limited, Cumbria, United Kingdom

[21] Appl. No.: 303,685

[22] Filed: Jan. 17, 1989

[30] Foreign Application Priority Data

Feb. 3, 1988 [GB] United Kingdom ..... 8802318

[51] Int. Cl.[6] ..... H01Q 1/12; H01Q 1/34; H01Q 1/50; B25G 3/00

[52] U.S. Cl. ..... 343/878; 343/710; 343/719; 343/885; 403/41

[58] Field of Search ..... 343/878, 885, 343/888, 892, 719, 887, 789, 710, 872, 709, 873, 711; 403/41, 140, 343, 24, 220, 107

[56] References Cited

U.S. PATENT DOCUMENTS 4,685,822 1/1990 Pelton ..... 403/343

*Primary Examiner*—Gregory C. Issing

*Attorney, Agent, or Firm*—Pollock, Vande Sande & Priddy

[57] ABSTRACT

A structure comprises a first component subject to loading and connected to a second component via a load transmitting member so that the loading exerted by the first component is imposed on the second component. The first component includes a surface secured to a complementary first surface of said load transmitting member and the second component includes a surface secured to a complementary second surface of said load transmitting member. The load transmitting member and the second component are formed of materials having relatively superior and inferior mechanical properties, respectively and the area of said surface of the second component is greater than the area of said surface of the first component. The first component may be an antenna and the second component a radome for a submarine formed of, for example, syntactic foam. The load transmitting member may be formed from fibre-reinforced plastics material.

12 Claims, 5 Drawing Sheets

STRUCTURES SUBJECT TO LOADING

This invention relates to structures subject to loading and more particularly, but not exclusively, is concerned with such structures which are subject to bending and fatigue loading.

It is known to provide structures comprising a first component which is subject to loading and a second component connected to the first component whereby the loading is imposed on the second component. An example of such a structure is an appendage (such as an antenna) mounted on a radar-transparent cover (radome) protecting the radar antennae on the mast of a submarine. Such radomes and appendages are, of course, subject to depth pressure as the submarine submerges and moreover the pressure-cycling, which occurs between surface operation and deep diving, causes fatigue loading on the radomes, and any appendages mounted thereon. The loading on the appendages is transmitted to the radome itself and this additional loading can cause fracture of the radome.

SUMMARY OF THE INVENTION

It is one object of the present invention to provide an improved manner of mounting a first component which is subject to loading (for example an antenna or other appendage) externally upon a flexible second component (for example a radome) so as to minimise the likelihood of the loading causing damage to the second component.

More generally, it is another object of the present invention to provide a manner of connecting together first and second components which have different stiffnesses and which are to be subject to bending moments when connected together.

It is a further object of the present invention to provide a means whereby a static or transient loading imposed by a first component on one part of a flexible second component may be spread evenly over a much larger area of the second component so that the stress levels produced by the spread loading do not exceed the fracture strength of the material from which the second component is composed.

According to the present invention there is provided a structure comprising a first component subject to loading and connected to a second component via a load transmitting member so that the loading exerted by the first component is imposed on the second component, wherein the first component includes a surface secured to a complementary first surface of said load transmitting member, the second component includes a surface secured to a complementary second surface of said load transmitting member, said load transmitting member and the second component are formed of materials having relatively superior and inferior mechanical properties, respectively, and the area of said surface of the second component is greater than the area of said surface of the first component.

The load transmitting member thus attaches the first component to the second component in a way such that the static and dynamic loadings on the second component due to the presence of the first component are spread evenly over a large area of the second component.

In a first embodiment of the present invention, a portion of the material from which the second component is constructed is progressively removed over an extended area surrounding the area of attachment of the first component, and replaced by the load transmitting member formed of the material having superior mechanical properties. The complementary surfaces of the second component and of the load transmitting member are in intimate contact with, and secured, to one another.

In this embodiment, the load transmitting member is incorporated into the actual fabric of the second component by using a material having superior mechanical properties to replace, in a progressive manner, the material from which the second component is constructed. The load transmitting member used in accordance with the invention will generally extend well beyond the area of attachment of the first component to the load transmitting member, e.g. 1½ or more times the diameter of the area, if circular. Furthermore, the member is tapered and contoured to the profile of the surface of the second component. The tapering is such that the thickness of the load transmitting member decreases as its distance from the centre line of the attachment area increases. The importance of providing the member with a tapered section should not be underestimated as sharp changes in section, e.g. sharp corners, etc., can act as "stress raisers".

In a second embodiment of the invention, no portion of the material of which the second component is constructed is removed. In this case the load transmitting member is used to supplement the existing thickness of the second component under and around the area of attachment. Again, the member will be tapered and 'faired in' to conform with the contours of the second component. As the complementary surfaces of the second component and load transmitting member are firmly bonded together, the mechanical properties of the combination of these parts are the sum of the properties of the full thickness of the material of the second component plus the properties of the varying thicknesses of the material constituting the load transmitting member.

In one possible application of the present invention, the second component is a radome constructed of a radar-transparent material, e.g. syntactic foam, which is weak under tensile and shearing loads. The load transmitting member may be formed of glass fibre-or carbon fibre-reinforced plastics material (GRP or CFRP). The mechanical properties of both GRP and CFRP are superior to those of syntactic foam and can be varied depending on how the fibres are 'laid up'. It is thus possible to vary the mechanical properties within the load transmitting member to gain a particular range of properties across its tapered section.

The complementary surfaces of the load transmitting member and the second component are bonded directly and firmly together e.g. by a strong adhesive, so that the combination behaves as a single body. In these circumstances, the materials of the second component and the load transmitting member would deflect together under load and their individual bending strengths would act in a cumulative manner.

The mathematical principle of Finite Element Analysis is well suited to the study of non-regular structures, e.g. tapered and/or curved sections, and the determination of what properties are required at particular points along the section to give a desired response under a given load. This principle is applicable to the combination of materials herein disclosed and may thus be used to define the material thicknesses and mechanical properties needed to, for example, maintain the shear force constant, or nearly constant, from the area of attachment and out beyond the edges of the load transmitting member into the body of the second component.

For a better understanding of the invention and to show how the same may be carried into effect, reference will now be made, by way of example only, to the accompanying drawings.

DETAILED DESCRIPTION OF THE INVENTION

Figure 1:
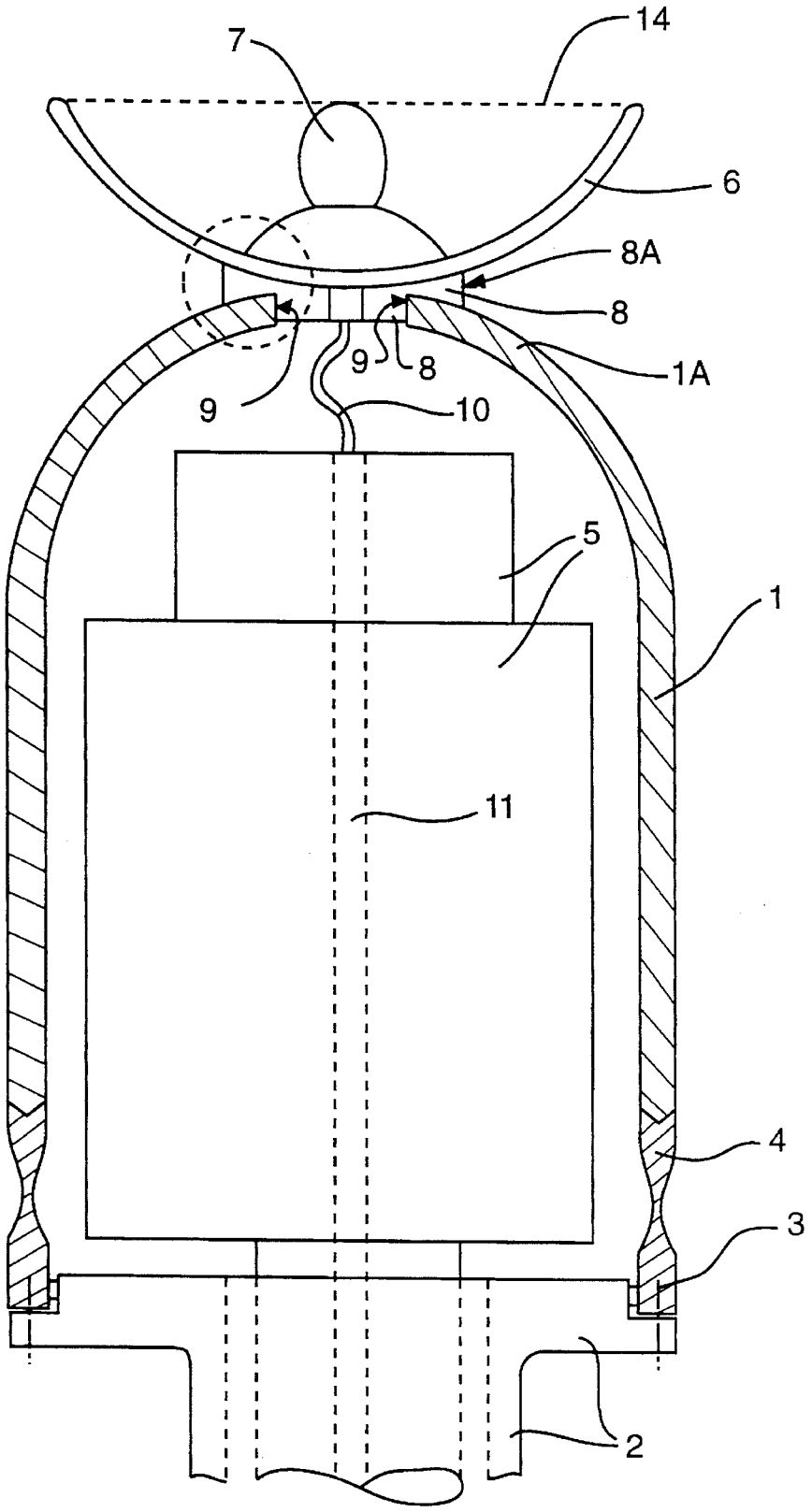
FIG. 1 is a sectional elevation of a radome with an antenna conventionally mounted thereon.

Referring to FIG. 1 there is shown a radome 1 mounted on a submarine's mast 2 via a mounting ring 3 and a flexible member 4 as disclosed in our co-pending British patent application No.8719457. Radome 1 covers radar antennae 5. Attached to the radome 1 is an appendage in the form of a further antenna comprising a dish 6, a transmitter/receiver 7, and a part 8 by means of which it is mounted on the crown 1A of the radome 1. Part 8 of the further antenna penetrates radome 1 via a hole 9. Cabling 10 connects transmitter/receiver 7 flexibly via axial ducting 11 in the antennae 5 into mast 2.

Figure 2:
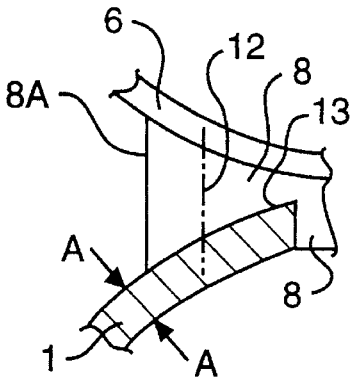
FIG. 2 is a part sectional elevation of a detail of FIG. 1.

The inset, FIG. 2, shows on a larger scale how part 8 connects the appendage to radome 1 via either an adhesive bond and/or mechanical means as indicated by centrelines 12. It will be noted that the upper surface of part 8 is profiled to be a close fit with the underside of dish 6. Similarly the lower surface of part 8 is profiled so as to be complementary with the upper surface of the radome 1. The complementary surfaces 13 of member 8 and radome 1 may also be glued.

Mast 2 is a telescopic device withdrawn into the bridge fin of the submarine when not in use and extended vertically upwards when deployed. When withdrawn into the bridge fin, the upper plane 14 of dish 6 will normally be just below the top of the fin, or possibly covered by a hydrodynamic fairing.

One of the most common ways in which a submarine may be attacked is by means of depth charges. When a depth charge explodes, it creates a spherical pressure wave which radiates outwards. Clearly, if a depth charge were to explode vertically above the fin, the pressure wave front would be approximately parallel to plane 14. Because of the shape of dish 6, the force due to the pressure wave would be concentrated, via part 8, onto the crown 1A of radome 1 over the circle bounded by circumferential face 8A of part 8; this would cause high shearing forces to be generated causing radome 1 to fracture somewhere in the plane AA (FIG. 2). Radome 1 is made of a material selected in part for its transparency to radar e.g. syntactic foam and such materials ordinarily have a relatively low resistance to shear stresses.

There is thus a need for a means of spreading the shear forces as nearly uniformly and as widely as possible so that they do not exceed the mechanical properties of the material of the radome.

Figure 3:
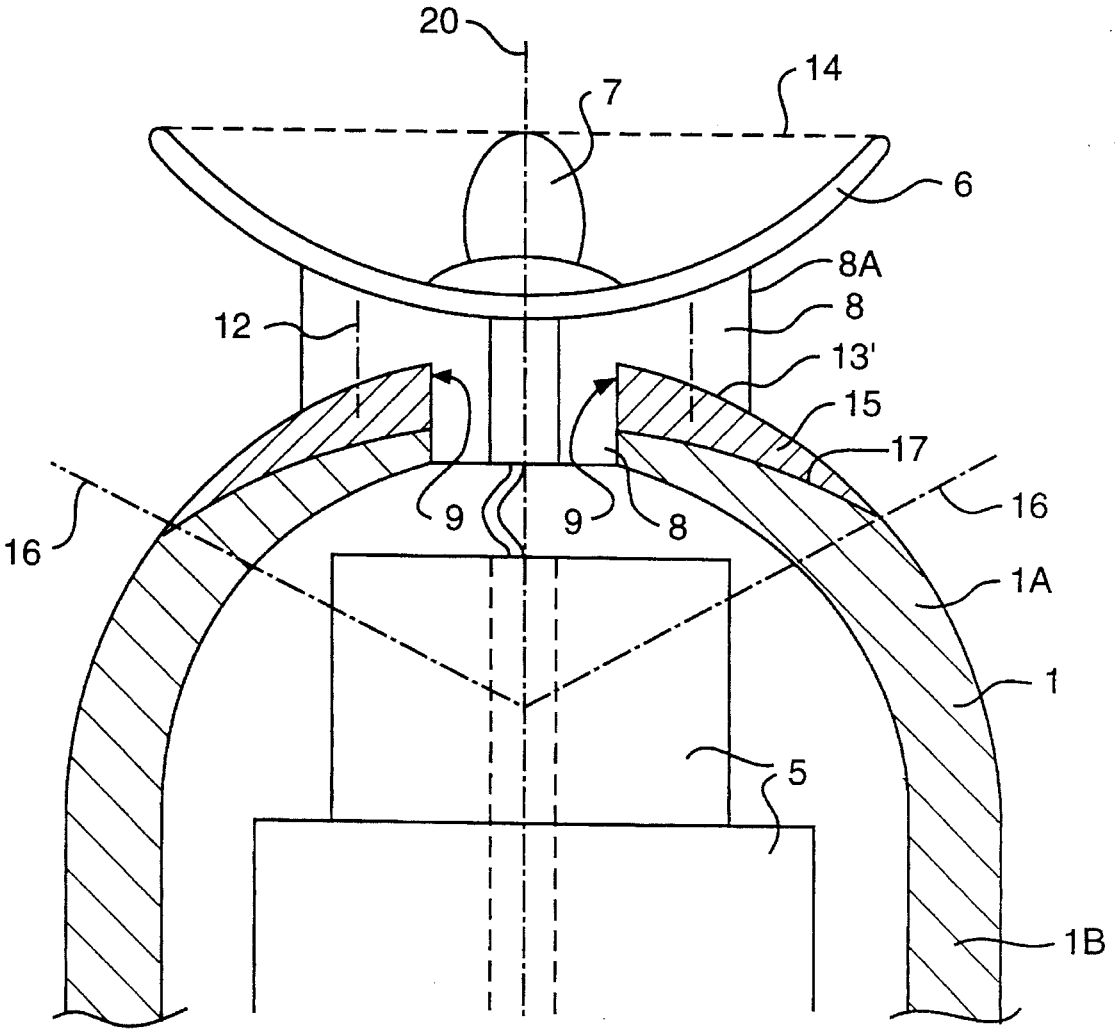
FIG. 3 is a sectional elevation of the upper part of a radome having an antenna mounted thereon in accordance with one embodiment of the invention.

Referring now to FIG. 3, there is shown one embodiment of the invention whereby the shear forces due to vertical loading may be spread. In this Figure, parts corresponding to parts of FIGS. 1 and 2 are denoted by like reference numerals.

In FIG. 3, a part of the upper portion 1A of the radome 1 has been omitted e.g. by machining it away, by appropriately casting the radome in the first place, or by a combination of both these techniques. The omitted portion has been replaced by a load transmitting member 15 formed of a tougher, non-metallic material, e.g. glass reinforced plastic (GRP) to give the same outer profile as the original radome (FIG. 1). GRP is only one of a number of non-metallic materials which could be used. Carbon fibre reinforced plastic (CFRP) is another. GRP and CFRP can be produced with a variety of mechanical properties depending on the directions and sequence in which the fibres are laid up. It is thus possible to vary the properties of member 15 from the outer circumference to the inner circumference in a linear or non-linear manner.

It can be seen that part 8 of the further antenna has an undersurface which is shaped so as to be complementary to the upper surface of the load transmitting member 15 to which it is secured. Similarly, the lower surface of the load transmitting member 15 is complementary to the upper surface of the crown 1A of the randome 1. The area of attachment of the load transmitting member 15 to the crown 1A (i.e. as represented by the complementary surfaces 17) is greater than the area of attachment of the further antenna to the load transmitting member 15 (i.e. as represented by the complementary surfaces 13'). Further it will be noted that the thickness of the intermediate member 15 decreases with an increase in distance from the centre line 20 so that the peripheral edges of the load transmitting member 15 are "faired" into the crown 1A of the radome 1.

The example shown is of a symmetrical structure. However the principle underlying the invention is equally applicable to non-symmetrical arrangements in which case the shape of the load transmitting member 15 and the fairing of it into the second component would reflect the nature of the non-symmetricality.

Lines 16 indicate the upper limit of the window of revolution swept by the beam from radar antennae 5. GRP and CFRP have poor transparency at radar frequencies; hence member 15 is restricted in extent to the area above the window defined by lines 16 in order to avoid reducing the size of this window. Thus member 15 starts at a point where lines 16 cut the outer surface of radome 1 and continues radially inwards to the hole 9.

If the mechanical properties of the member 15 and radome 1 were identical and the two components were properly bonded together, the composite part of the radome would behave in exactly the same way as the unaltered radome 1 in FIG. 1. However, it is the purpose of the invention to strengthen the crown 1A of radome 1, so the member 15 is designed to have superior mechanical properties, e.g. bending stiffness, tensile strength, etc. than the radome 1.

If these superior properties were the same throughout member 15, then the net mechanical properties of the combination would increase radially inwards on a progressive basis due to the increasing thickness of member 15.

Conversely, if the more central portions of member 15 were laid up to give a further increase in mechanical properties, then the net properties of the combination would increase more rapidly radially inwards, e.g. in a steep ramp or exponential fashion. A third variation involves locating the material with the highest mechanical properties in the outer part of the annular member 15. In this case, the properties of the combination, although always higher than those of the basic radome itself can be kept fairly constant across its radial dimension, or even increase towards the outer circumference.

By providing load transmitting member 15 in accordance with the present invention, a load on dish 6, particularly a near-vertical shock load, may be spread evenly over the crown 1A of radome 1 and thence axially down into the cylindrical section 1B. The exact design of member 15 to perform this function will depend on:

i) the diameter of cylindrical section 1B of radome 1, ii) the wall thickness of radome 1, iii) the mechanical properties of the material of which radome 1 is made, iv) the nature and range of mechanical properties of member 15, v) the radius of hole 9 in radome 1, and vi) the diameter of part 8, i.e. the radius of the circumferential face 8A.

The mathematical method of finite analysis is the most appropriate tool with which to determine the design of member 15. The principles of finite element analysis are described in "The Finite Element Method A—Basic Introduction for Engineers" by Rockey, Evans, Griffiths and Nethercot (Granada Publishing Limited 1985). It can be used to predict stress levels in a structure under given loading conditions, or conversely, the mechanical properties required to achieve a given stress level under load. In this case, the requirement is to produce as uniform a shear force distribution over member 15 and crown 1A as possible.

Figure 4:
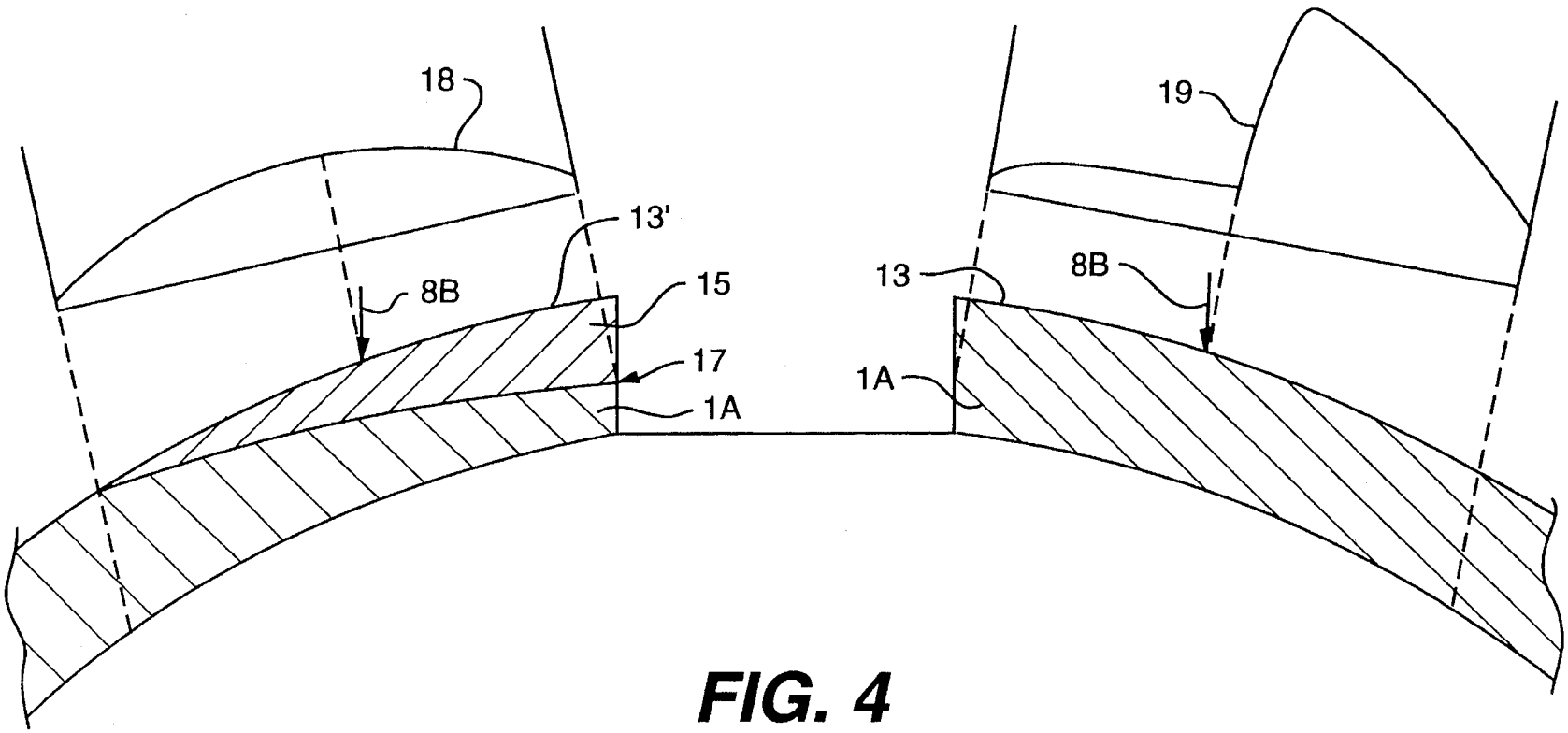
FIG. 4 is a first section through the upper part of the radome shown in FIG. 3 and a second section through the upper part of the radome shown in FIG. 1 illustrating the shear force distributions due to vertical loading in each case.

FIG. 4 shows an enlarged section of member 15 and the adjacent part of the crown 1A on the left and the unaltered crown on the right. Arrows 8B indicate the line of action of the cylindrical edge of face 8A of member 8. Shear force diagram 18 shows how, with the proper design of member 15 as disclosed above, nearly uniform conditions can be achieved over the whole radial length of member 15 and, though not shown, continuing into crown 1A. Diagram 18 may be compared with corresponding diagram 19 for the unaltered crown 1A; in this case a sharp increase in shear force occurs at the arrow 8B marking the line of action of the edge of circumferential face 8A. This would almost certainly cause failure of the crown IA which does not possess great shear strength.

Member 15 could be incorporated in one of two ways. It could be laid up directly on crown 1A in which case their complementary surfaces 17 would be bonded directly,together by means of the lowest layer of adhesive used when laying up the member. Alternatively, it could be laid up on a separate former and subsequently glued to the radome with their complementary surfaces 17 in contact with one another. When the glue has set, member 15 (and crown 1A, if necessary) can be machined to the required profile. In either case, the complementary surfaces 17 would be joined by an adhesive and not by a mechanical means since screw or bolt holes would act as "stress raisers" in the material of crown 1A. However, as GRP is less susceptible to stress cracking, screws or bolts could be used to fix part 8 to member 15 as indicated by centrelines 12 on FIGS. 2 and 3.

It will be noted that member 15 is 'faired' into crown 1A at the limit of window 16. This is to eliminate rapid changes of section and sharp corners which could act as "stress raisers" and so be sources of weakness.

Figure 5:
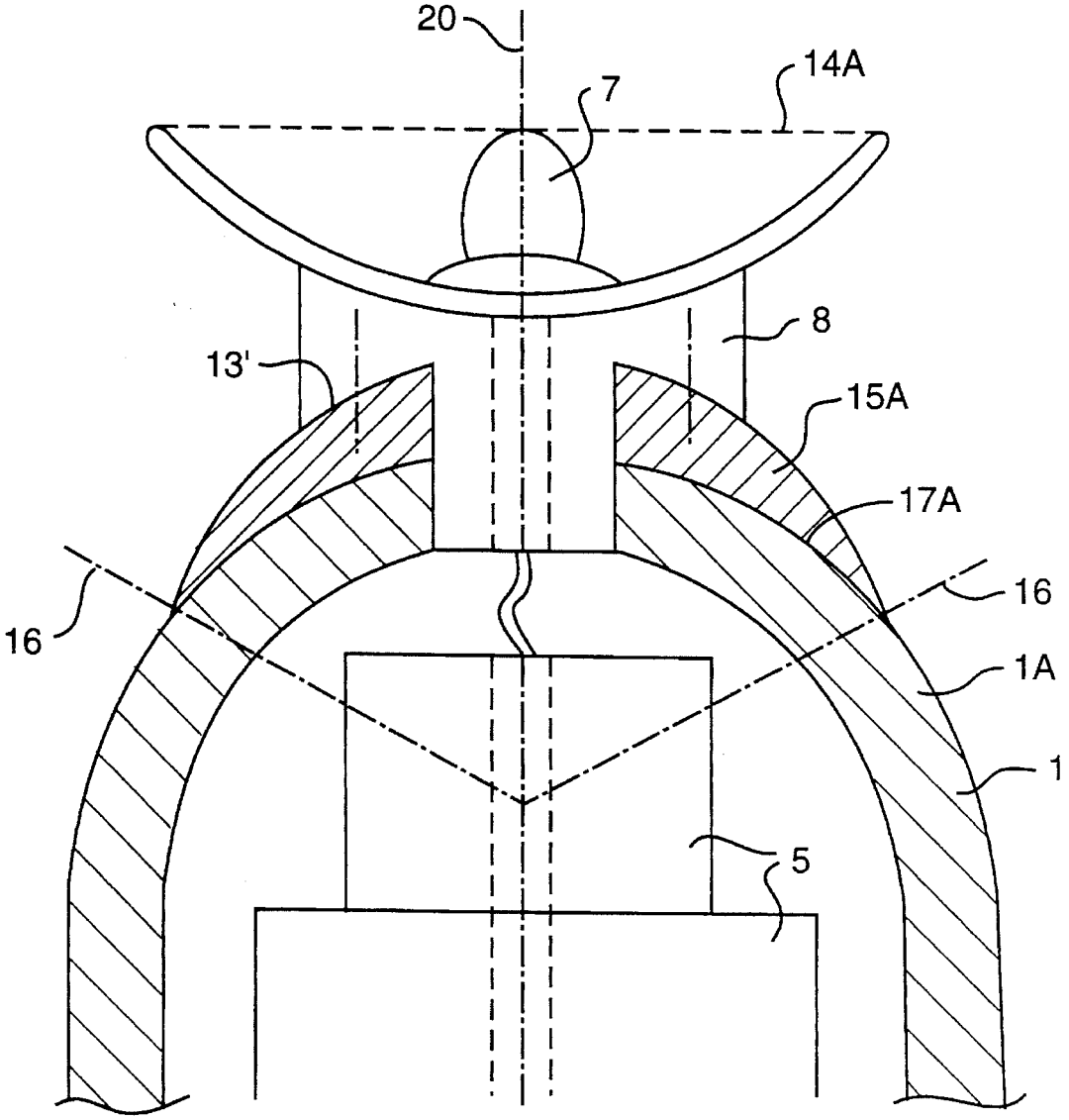
FIG. 5 is a sectional elevation of the upper part of a radome having an antenna mounted thereon in accordance with another embodiment of the invention.

FIG. 5 shows another embodiment of the invention whereby the shear forces due to vertical loading may be spread. Again, parts corresponding to parts of the previous Figures are denoted by like reference numerals. In this case, the section of crown 1A is unchanged and the load transmitting member (here denoted 15A) is affixed on top of crown 1A by bonding their complementary surfaces 17A together or by laying up member 15A in situ. This embodiment does however result in an overall increase in the height of the whole structure from plane 14 (FIG. 3) to plane 14A. In many applications, this height increase is not important in which case the FIG. 5 design may be preferable to that of FIG. 3 because less preparation of the surface of crown 1A is required and there is greater freedom available to the designer to provide additional strength to the crown 1A. However, in submarine applications, space is at an absolute premium, even in the bridge fin; consequently no increase in overall height may be possible in which case the FIG. 3 design would be used.

Figure 6:
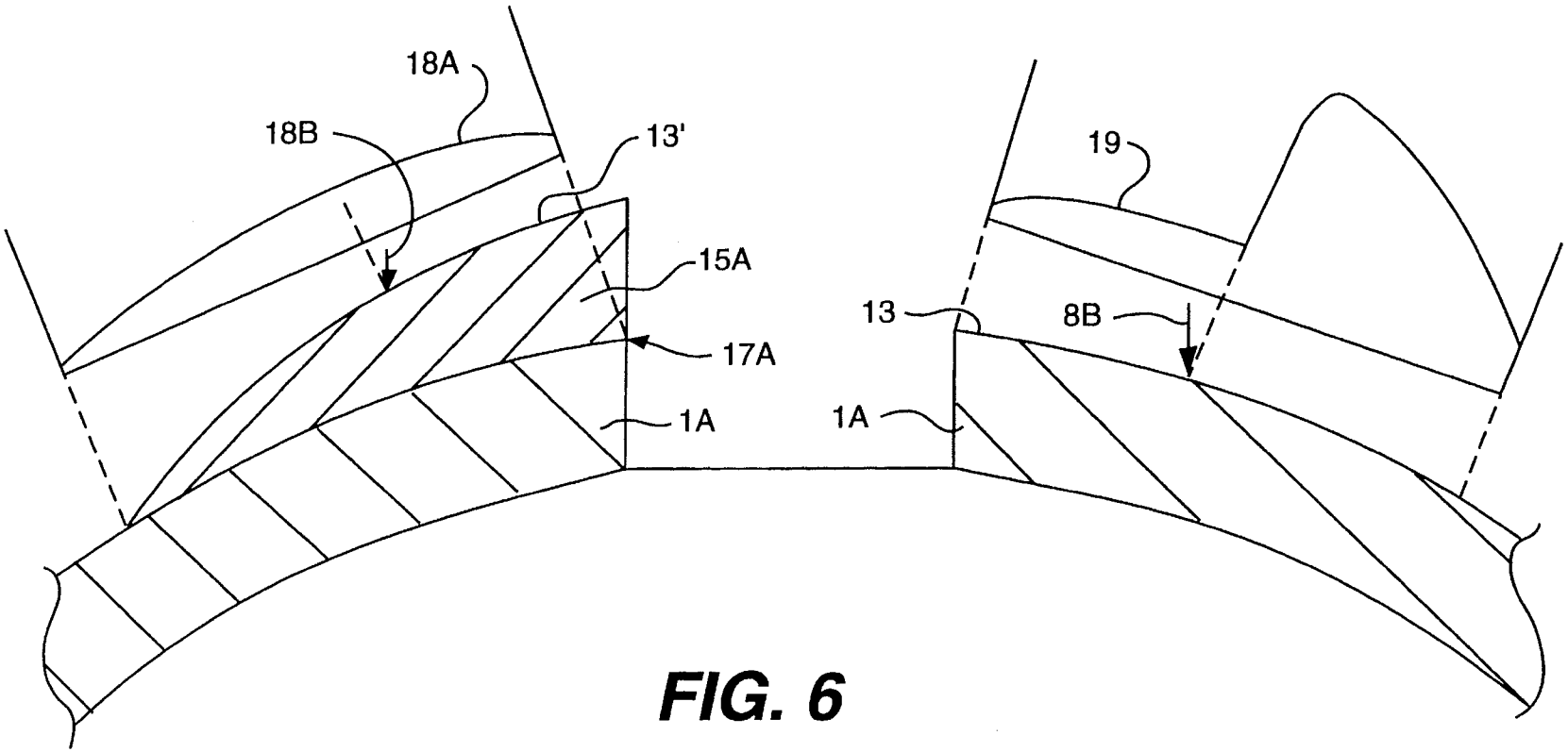
FIG. 6 is a first section through the upper part of the radome shown in FIG. 5 and a second section through the upper part of the radome shown in FIG. 1 illustrating the shear force distributions due to vertical loading.

Referring to FIG. 6, this shows shear force diagrams 18A and 19 corresponding to shear force diagrams 18 and 19 of FIG. 4. Parts corresponding to parts of FIG. 4 are again denoted by like reference numerals. In this case, the curve in diagram 18A is lower than that in diagram 18 since no material has been removed from crown 1A in the embodiment of FIG. 5 and this provides additional strength over the embodiment of FIG. 3.

It will be noticed that the members 15 and 15A are placed in or on the upper surfaces of crowns 1A and not in or on the underside. This is because any shock loading will come from above plane 14/14A and thus the force applied will have a component in the vertically downward direction. This will place the adhesive bond between complementary surfaces 17 or 17A in compression. Had members 15/15A been on the underside of crowns 1A, the shock load would apply a tensile force. It is well known that adhesives are strong in compression, fairly strong in shear but weak in tension. It will thus be seen that by careful positioning of the members 15/15A, at least part of the bond between surfaces 17 or 17A will experience a perpendicular loading from most overhead shocks. Other parts of the bond will receive a shear loading, the resistance to which will be supplemented by the spigot portion of part 8 which extends through both the load transmitting member 15/15A and the crown 1A. It is usually the case that the positive pressure wave from a depth charge is followed by a negative pulse which would apply a reverse, i.e. tensile, force on the bond. However, this second pulse is always of lower magnitude than the first. Also, because it would act on the convex underside of dish 6, its effect would be very much reduced.

I claim:

1. A structure comprising a first component subject to loading and connected to a flexible second component having relatively low resistance to tensile and shearing loads, via a load transmitting member so that the loading exerted by the first component is imposed on the second component, the first component having a surface secured to a complementary first surface of said load transmitting member, the second component includes a surface bonded to a complementary second surface of said load transmitting member, said load transmitting member and the second component being formed of materials having relatively superior and inferior bending stiffness and tensile strength respectively, and the area of said surface of the second component being greater than the area of said surface of the first component.

2. A structure as claimed in claim 1 wherein the load transmitting member replaces a portion of the material from which the second component is constructed, and extended over an area which includes the area of attachment of the first component with the load transmitting member.

3. A structure as claimed in claim 1 wherein the load transmitting member supplements the second component under and around the area of attachment of the first component to the load transmitting member.

4. A structure as claimed in claim 1 wherein the load transmitting member is tapered to have a surface to conform with the contours of a surface of the second component.

5. A structure as claimed in claim 1 wherein the first component includes a spigot located in a hole extending through the load transmitting member and into the second component.

6. A structure as claimed in claim 1 which includes an axis of symmetry extending through the area of attachment of the first component to the load transmitting member and through the area of attachment of the load transmitting member to the second component.

7. A structure as claimed in claim 6 wherein the areas of attachment of the first component to the load transmitting member and of the load transmitting member to the second component are circular.

8. A structure as claimed in claim 7 wherein the diameter of the area of attachment of the load transmitting member to the second component is significantly greater than the diameter of the area of attachment of the first component to the load transmitting member.

9. A structure as claimed in claim 8 wherein the diameter of the area of attachment of the load transmitting member to the second component is at least 1½ times the diameter of the area of attachment of the first component to the load transmitting member.

10. A structure as claimed in claim 1 wherein the load transmitting member is formed of fibre-reinforced plastics material and the second component is formed of syntactic foam.

11. A structure as claimed in claim 1 wherein the second component is a radome and the first component is an antenna.

12. A structure comprising a submarine antenna connected to a flexible radome having relatively low resistance to tensile and shearing loads via a load transmitting member, so that the loading experienced by the antenna is imposed on the radome, the antenna having a surface secured to a complementary first surface of said load transmitting member, the radome having a surface secured to a complementary second surface of said load transmitting member, said load transmitting member and the radome being formed of materials having relatively superior and inferior bending stiffness and tensile strength, respectively, and the area of said surface of the radome being greater than the area of said surface of the antenna.

* * * * *